US005163581A

United States Patent [19]

Lombardi, Jr.

[11] Patent Number: 5,163,581

[45] Date of Patent: Nov. 17, 1992

[54] DISPENSER CARTRIDGE FOR COSMETICS SAMPLE MINI-COMPACTS

[75] Inventor: Carl M. Lombardi, Jr., Huntington, N.Y.

[73] Assignee: Anna Young Associates, Ltd., Freeport, N.Y.

[21] Appl. No.: 627,773

[22] Filed: Dec. 14, 1990

[51] Int. Cl.[5] ..... B65G 59/00

[52] U.S. Cl. ..... 221/256; 211/266; 211/312 R; 211/283; 206/235; 132/320

[58] Field of Search ..... 256/581, 235, 823, 37, 256/1.9; 132/286, 293, 317, 320; 221/266, 281, 312 R, 312 C, 282, 283, 255-257

[56] References Cited

U.S. PATENT DOCUMENTS

| | | | |
|---|---|---|---|
| 1,889,875 | 12/1932 | Parker | 221/283 |
| 2,965,264 | 12/1960 | Silvia | 221/257 |
| 3,161,320 | 12/1964 | Swanson | 221/255 |
| 4,346,817 | 8/1982 | Karcher | 221/312 R |
| 4,569,438 | 2/1986 | Sheffler | 206/235 |
| 5,031,647 | 7/1991 | Seidler | 206/581 |

FOREIGN PATENT DOCUMENTS

| | | | |
|---|---|---|---|
| 27291 | 5/1924 | France | 206/37 |
| 1035074 | 8/1953 | France | 132/293 |

*Primary Examiner*—H. Grant Skaggs
*Attorney, Agent, or Firm*—Michael Ebert

[57] ABSTRACT

A dispenser cartridge loaded with identical mini-compacts containing a test sample of a particular cosmetic such as lip gloss or eye shadow, thereby making it possible for consumers, before purchasing this cosmetic, to try out the sample. The cartridge, which is vertically mounted, includes a gravity-feed channel accommodating a stack of mini-compacts, the lowermost of which rests on a ledge in alignment with an exit slot. Below the slot is a slidable ejector which when pulled out acts to withdraw the lowermost mini-compact through the slot. And when the ejector, after the withdrawn mini-compact is removed therefrom, is pushed back, then the mini-compact, which is now lowermost, falls on the ledge in readiness for the next ejector action. The cartridge, when exhausted, is refillable through a channel inlet at the upper end of the cartridge.

9 Claims, 4 Drawing Sheets

Fig. 4.
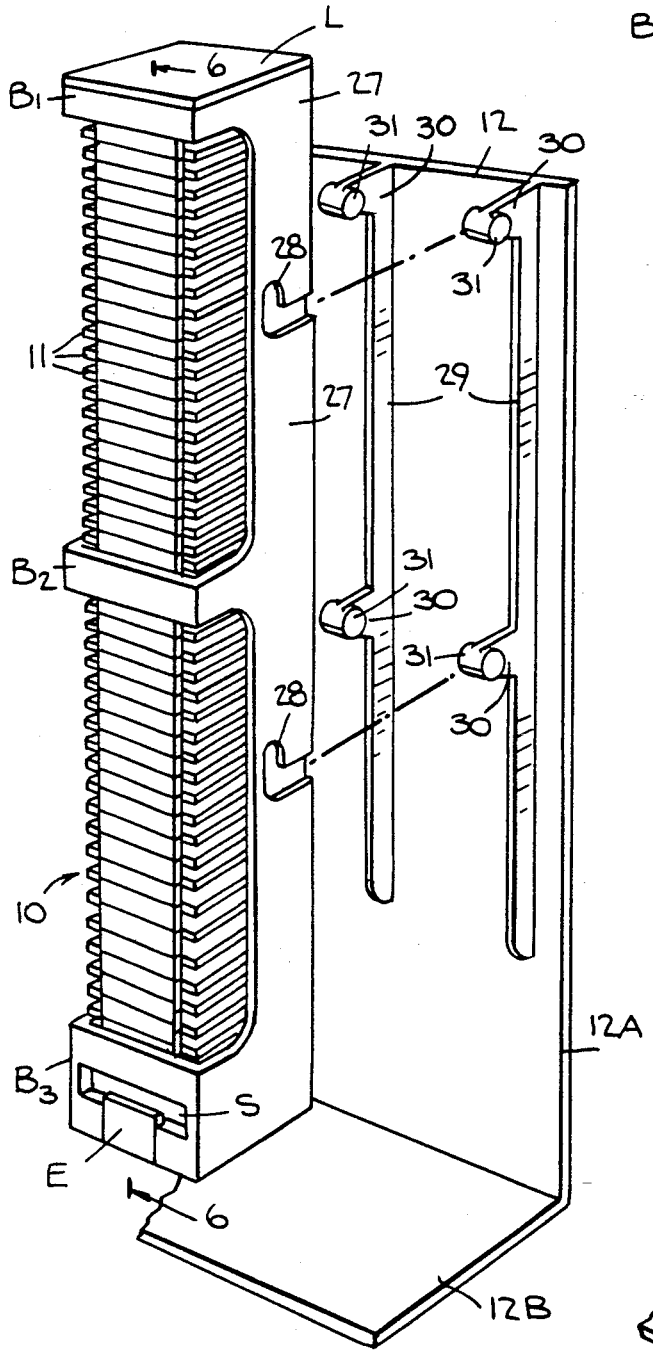
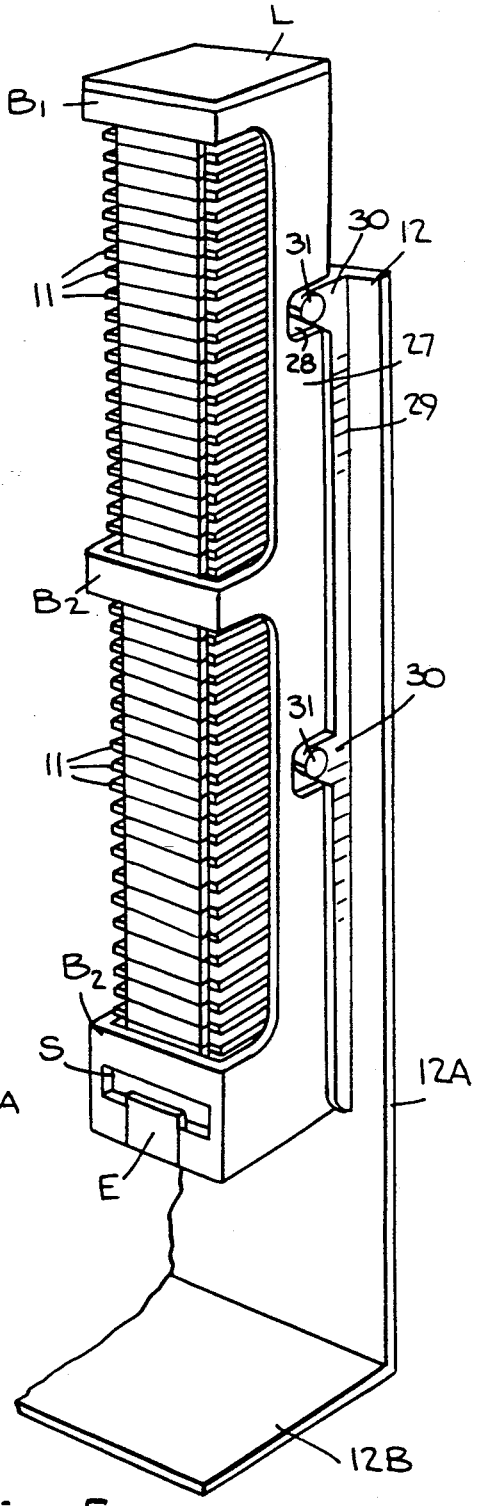
Fig. 5.

Fig. 10.
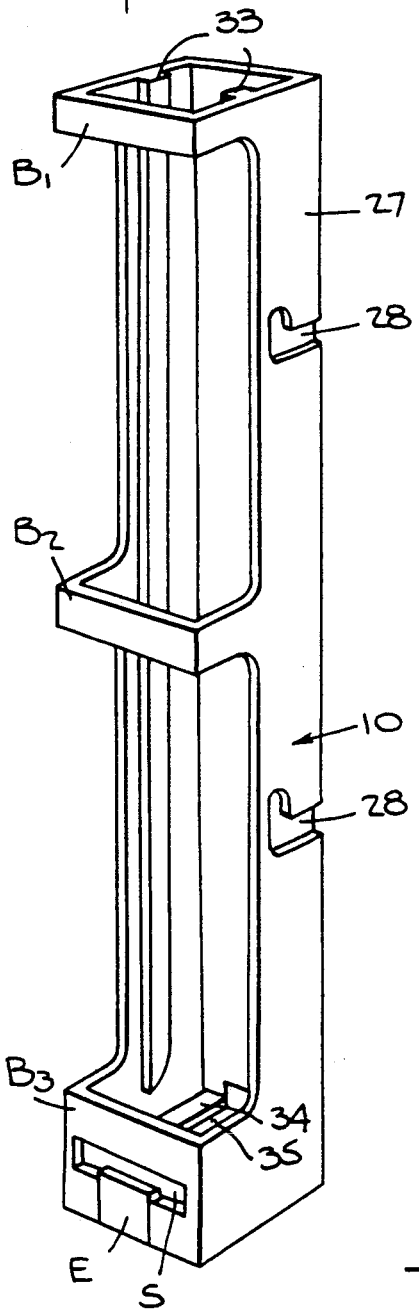
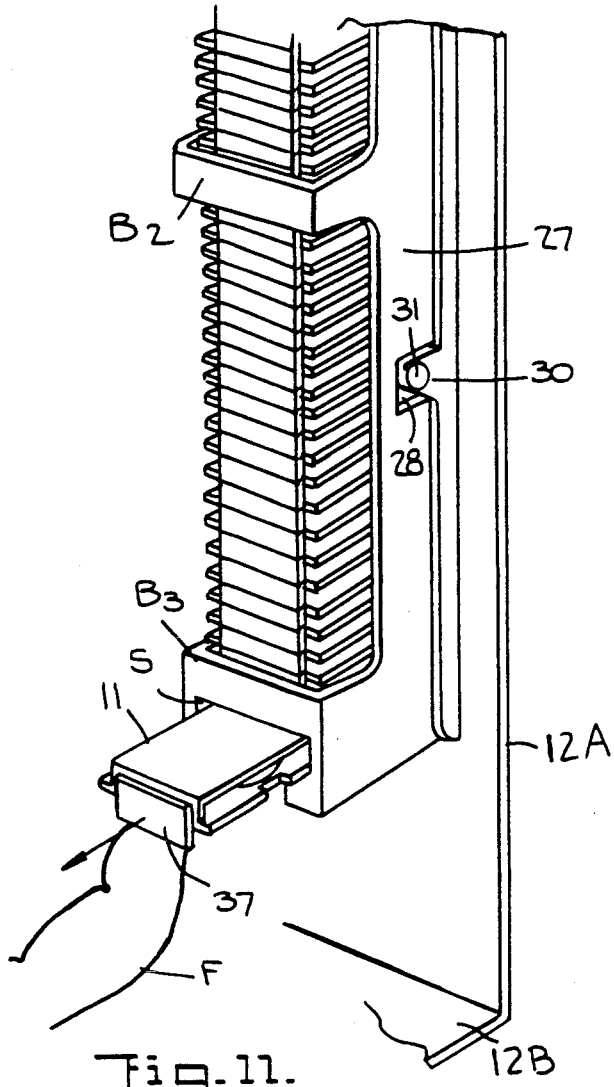
Fig. 11.
Fig. 12.
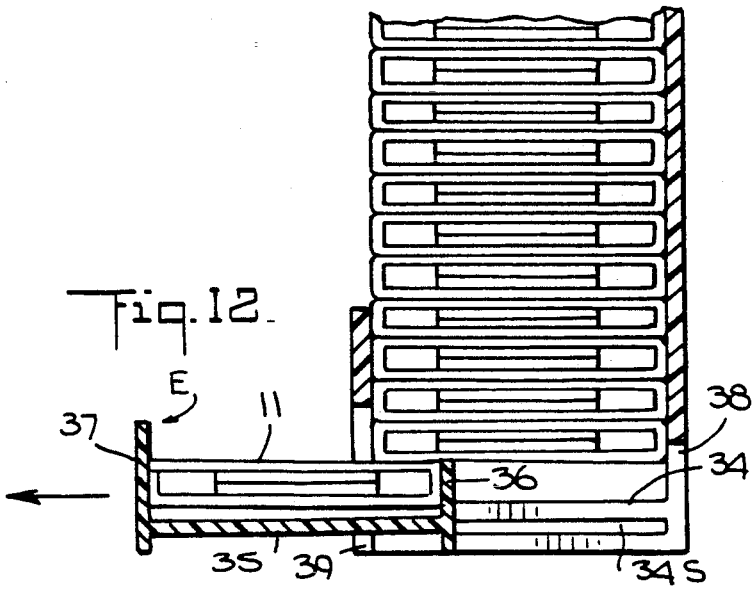

DISPENSER CARTRIDGE FOR COSMETICS SAMPLE MINI-COMPACTS

BACKGROUND OF INVENTION

1. Field of Invention

This invention relates generally to disposable miniature compacts or mini-compacts containing a test sample of a particular cosmetic, making it possible for a consumer who may be interested in purchasing this cosmetic to first try it out, and more particularly to a dispenser cartridge loaded with a stack of such mini-compacts and dispensing, on demand, one mini-compact at a time.

2. Status of Prior Art

Viscous, semi-solid and solid cosmetics, such as face creams, pressed powder, lip gloss and blusher are sold in containers appropriate to the nature of the cosmetic, such as jars, squeeze tubes and dispenser sticks. Powder, when in pressed form, is usually contained in a compact constituted by a small case having a lid hinged thereto, such as compacts of the type disclosed in U.S. Pat. Nos. 2,042,242 and 2,137,886.

A typical cosmetic section of a department store or a retail establishment that specializes in cosmetics carries on its shelves a broad range of cosmetics of various types and brands. The merchandising of cosmetics is complicated by the fact that the typical consumer is a woman who prides herself on her appearance and is not likely to purchase a cosmetic that she had not previously used without first trying it out to determine whether the product satisfies her needs in regard to color, fragrance, absorption, smoothness and other characteristics related to the nature of the cosmetic.

The retail cosmetic field is highly competitive, and many brands of a particular cosmetic, such as lip gloss, vie for a consumer's attention. In order to promote the sale of cosmetics by making it possible for a consumer to test a cosmetic to see whether it meets with her personal requirements, many cosmetic retail establishments provide the consumer with a small sample of the cosmetic. To this end, placed in the counter are open jars and other containers of various cosmetics available for purchase, from which the consumer or the sales clerk may extract a small sample which the consumer can then apply to her skin and examine.

Open cosmetic jars and other containers to which frequent access is had present a serious problem in regard to health and hygiene in an age when some consumers who are given access to these containers may be suffering from contagious diseases. It is for this reason that the use of a finger to extract a cosmetic sample from an open jar is interdicted, and the common practice is to use a sterile cotton swab as a sampling tool. But even then with open cosmetic jars being in constant use by a stream of potential purchasers, sterile conditions are not assured. Moreover, in a busy store, the need to provide on a cosmetic counter many sampling jars reduces the amount of space available for sales transactions.

Another drawback of the present sampling practice is that a prospective purchaser who is unable to make up her mind at the counter cannot take the sample home to run a test and there reach a decision as to whether to purchase the sampled cosmetic.

SUMMARY OF INVENTION

In view of the foregoing, the main object of this invention is to provide a miniature disposable cosmetic compact or mini-compact containing a sealed, sterile sample of a particular cosmetic, thereby making it possible for a prospective purchaser to try out the cosmetic at the retail establishment or to do so at home to determine whether to purchase this cosmetic.

More particularly, an object of this invention is to provide a dispenser cartridge loaded with identical mini-compacts, the cartridge being adapted, on demand, to discharge one mini-compact at a time.

An important feature of a mini-compact in accordance with the invention is that it not only lends itself to being loaded in a dispenser cartridge, but it may also be mounted on a small advertising display card or be freely distributed for promotional purposes.

Also an object of the invention is to provide an array of dispenser cartridges loaded with mini-compacts and supported on a common stand placeable on a counter, each cartridge dispensing a different cosmetic sample so that a consumer may readily choose those samples she wishes to test.

Among the significant advantages of the invention are the following:

A. It makes possible an organized and low cost sampling system in which all cosmetic samples are sealed and maintained in sterile condition.

B. Each cosmetic sample mini-compact can be labelled on its lid to identify the maker and brand of the cosmetic, whereby the consumer after testing the sample can then order the cosmetic either in the store, or by phone or by mail.

C. The dispenser cartridges, after being exhausted, can be readily refilled.

D. A consumer can be provided with a large number of mini-compacts containing different samples, from which she can run tests and select those cosmetics she finds appealing.

Briefly stated, these objects are attained in a dispenser cartridge loaded with identical mini-compacts containing a test sample of a particular cosmetic such as lip gloss or eye shadow, thereby making it possible for consumers, before purchasing this cosmetic, to try out the sample. The cartridge, which is vertically mounted, includes a gravity-feed channel accommodating a stack of mini-compacts, the lowermost of which rests on a ledge in alignment with an exit slot.

Below the slot is a slidable ejector which when pulled out acts to withdraw the lowermost mini-compact through the slot. And when the ejector, after the withdrawn mini-compact is removed therefrom, is pushed back, then the mini-compact, which is now lowermost, falls on the ledge in readiness for the next ejector action. The cartridge, when exhausted, is refillable through a channel inlet at the upper end of the cartridge.

An array of such cartridges may be vertically supported on a common stand, each cartridge being loaded with a different cosmetic sample, so that a consumer may then choose which samples she desires to test.

BRIEF DESCRIPTION OF DRAWINGS

For a better understanding of the invention as well as other objects and further features thereof, reference is made to the following detailed description to be read in conjunction with the accompanying drawings, in which:

FIG. 4 illustrates, in perspective, a dispenser cartridge withdrawn from its supporting stand;

FIG. 5 shows the same cartridge mounted on the stand;

FIG. 10 is a perspective view of an unloaded cartridge;

FIG. 11 is a perspective view of a loaded cartridge with its ejector pulled out to withdraw a compact from the stack thereof; and FIG. 12 is a longitudinal section of the cartridge with its ejector pulled out.

DETAILED DESCRIPTION OF INVENTION

Figure 1:
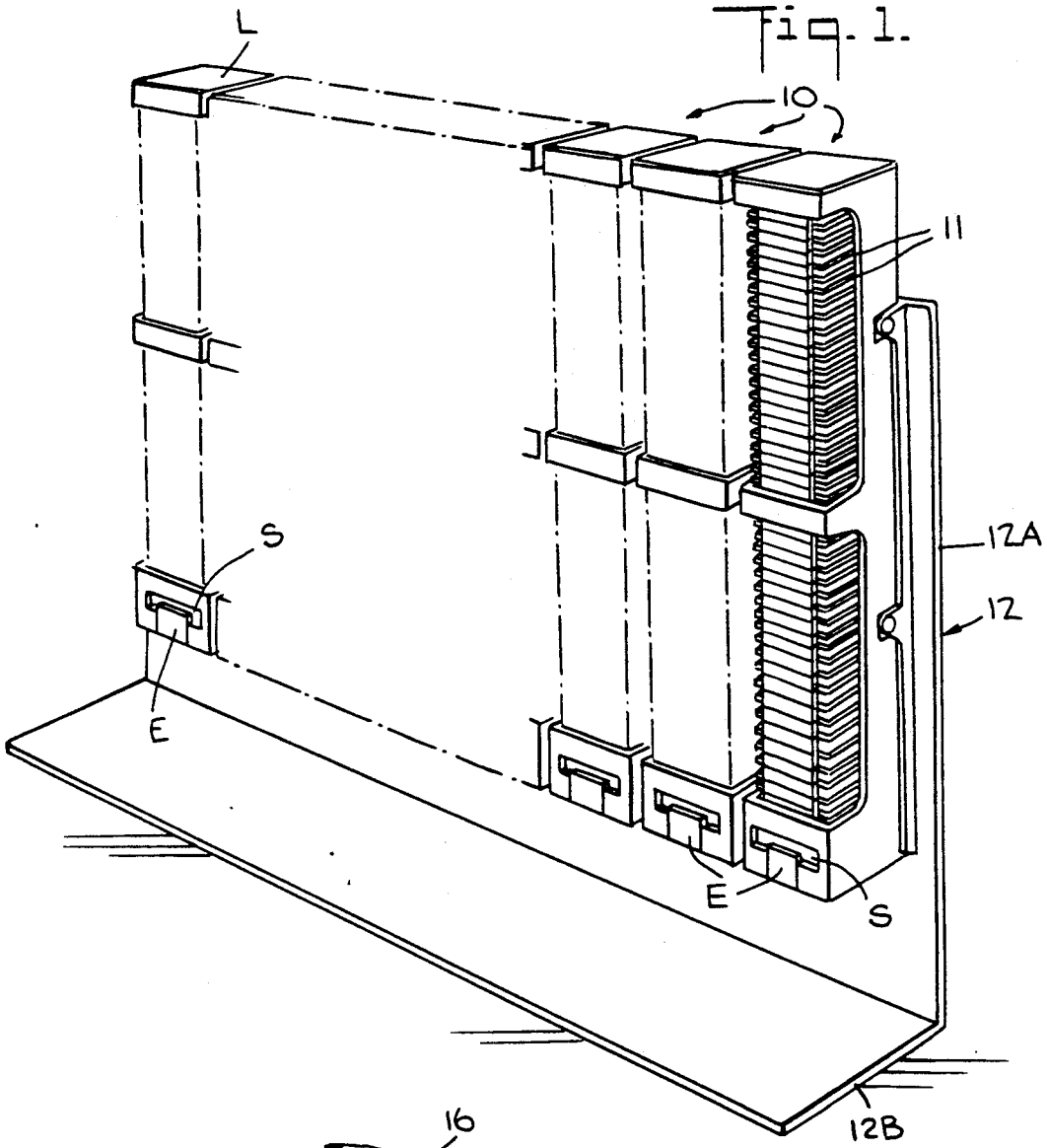
FIG. 1 is a perspective view of an array of dispenser cartridges in accordance with the invention loaded with miniature cosmetic compacts containing test samples.

Referring now to FIG. 1, there is shown an array of like dispenser cartridges 10 in accordance with the invention, mounted vertically on the back plate 12A of a stand 12 having a horizontal base 12B. In, practice, base 12B may be weighted to stabilize the stand. Each cartridge 10 has a channel formation and contains a stack of miniature cosmetic sample compacts or mini-compacts 11. The mini-compacts are loaded into the cartridge through an inlet at the upper end of the cartridge channel and are discharged, one at a time, through a front slot S by means of a slidable ejector E, which in FIG. 1 is shown in its retracted or pushed-in position. The inlet to the channel is normally closed by a removable lid L.

Figure 2:
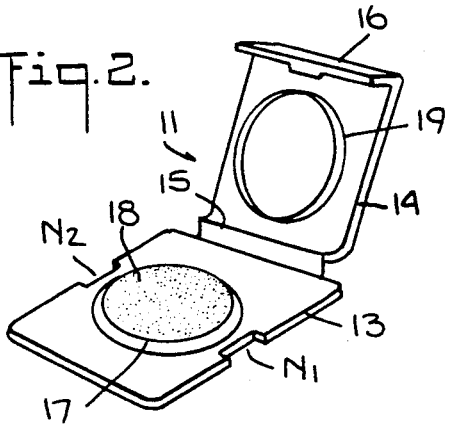
FIG. 2 is a perspective view of one preferred embodiment of a miniature cosmetic compact, shown with its lid open.

The mini-compacts 11 may be of the type shown in FIG. 2, in which the mini-compact is formed by a rectangular base plate 13 of a high-strength synthetic plastic material such as polyethylene or polyvinyl chloride, and a rectangular lid 14 formed of the same plastic material joined to the rear end of the base plate by a living hinge 15. In its closed state, lid 14 is parallel to base plate 13. Lid 14 is provided with a front latching apron 16 that when the lid is closed snaps over the front edge of the base plate. Typically, the dimensions of the base plate are one inch by one and one-eighth's inch, while the lid is somewhat narrower, so that when the lid is closed, the side margins of the base plate are exposed. These side margins are provided with opposing notches $N_1$ and $N_2$ dimensioned to receive rails formed in the sides of the cartridge channel, as will later be explained.

Formed on the face of base plate 13 is a circular shallow tray 17 filled with a cosmetic sample 18 whose nature depends on the cosmetic to be sampled. This sample may be in cream, paste, pressed powder or any other non-fluidic form. Formed on the inner surface of lid 14 is a complementary sealing ring 19 which, when the lid is closed, frictionally engages circular tray 17 to seal the cosmetic sample. In practice, to ensure sterility, the tray may be covered by a peel-off foil adhered to the rim of the tray.

Figure 3:
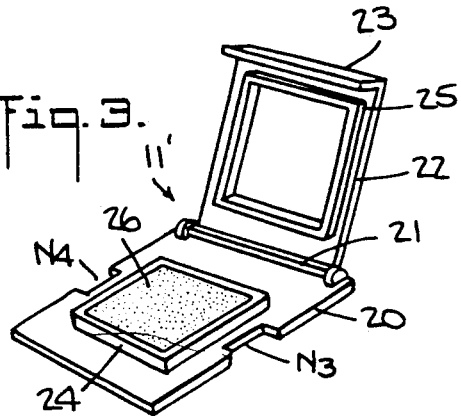
FIG. 3 is a perspective view of another preferred embodiment of a miniature cosmetic compact, shown with its lid open.

In the embodiment of the mini-compact 11' shown in FIG. 3, the rectangular base plate 20, which is provided with notches $N_3$ and $N_4$ on opposing margins, is hinged by a hinge pin 21 to a lid 22 having a front latching apron 23 which snaps over the front edge of the base plate when the lid is closed. In this embodiment, a square tray 24 is formed on the inner face of the base plate and a complementary sealing ring 25 is formed on the inner surface of the lid 22, which when closed frictionally engages the tray to seal the cosmetic sample 26 filling the tray.

Because when the lid of the mini-compact shown in FIGS. 2 and 3 is closed, the side margins of the base plate are exposed, the compact may be mounted on an advertising display card having parallel slits into which the exposed side margins are inserted to hold the mini-compact on the card. And the face of the lid may have a label thereon identifying the manufacturer of the cosmetic and its brand name.

The dimensions of the cosmetic tray included in the mini-compact are such as to accommodate the tip of a user's finger to extract the cosmetic sample or a portion thereof from the tray and to apply the extracted sample to the skin or elsewhere for test purposes. Thus in the case of a body cream, the user can rub the sample on the skin surface to feel how the cream is absorbed, whether it imparts smoothness to the skin, and to determine whether its color and fragrance are pleasing.

As shown in FIGS. 4 and 5, cartridge 10 is in a channel formation, the channel having a rectangular cross section defined by a back wall and parallel side walls 27 which are joined together by upper, intermediate and lower bridges $B_1$, $B_2$ and $B_3$. Each side wall 27 is provided with upper and lower mounting notches 28 having a horizontal inlet leading into a vertical locking notch. Formed on back plate 12A of the stand are parallel ridges 30 having a spacing therebetween to nest the cartridge, each ridge having upper and lower projecting lugs 30 which complement the mounting notches 28 on the cartridge and are provided at their extremities with circular knobs 31.

In installing the cartridge on the stand, the cartridge is placed between parallel ridges 30, and the knobs 31 are inserted in the inlets of notches 28, the cartridge then being lowered to cause the knobs to lock into the locking notch. To remove the cartridge from the stand, one then raises the cartridge to align the knobs with the inlet, the cartridge then being withdrawn.

An empty cartridge 10 with its lid removed to expose the channel inlet is shown in FIG. 10, where it will be seen that extending along the inner surface of the opposing side walls 27 are vertical rails 33. These rails fit within the side margin notches $N_1$ and $N_2$ (FIG. 2) or margin notches $N_3$ and $N_4$ (FIG. 3) of the mini-compacts, so that when these mini-compacts are loaded into the cartridge channel through the inlet thereto, they then run down the rails to be stacked one above the other in the channel, as shown in FIGS. 4 and 5.

Figure 9:
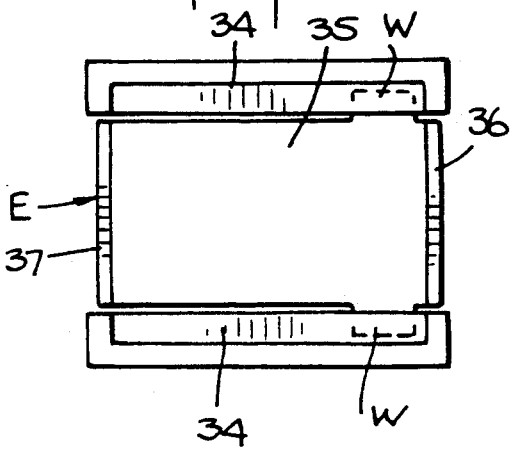
FIG. 9 is a transverse section taken through the cartridge in the plane indicated by line 9—9 in FIG. 6.

At the bottom end of the channels are parallel ledges 34 on which the lowermost mini-compact in the stack rests. Ejector E is formed by a narrow base plate 35 having wings W on either side of which are received in horizontal slots 34S formed in ledges 34 (see FIGS. 9 and 12), so that the ejector is slidable from a retracted to an extended position. Ejector E is provided with a rear plate 36 and a front plate 37 both at right angles to base plate 35.

Figure 6:
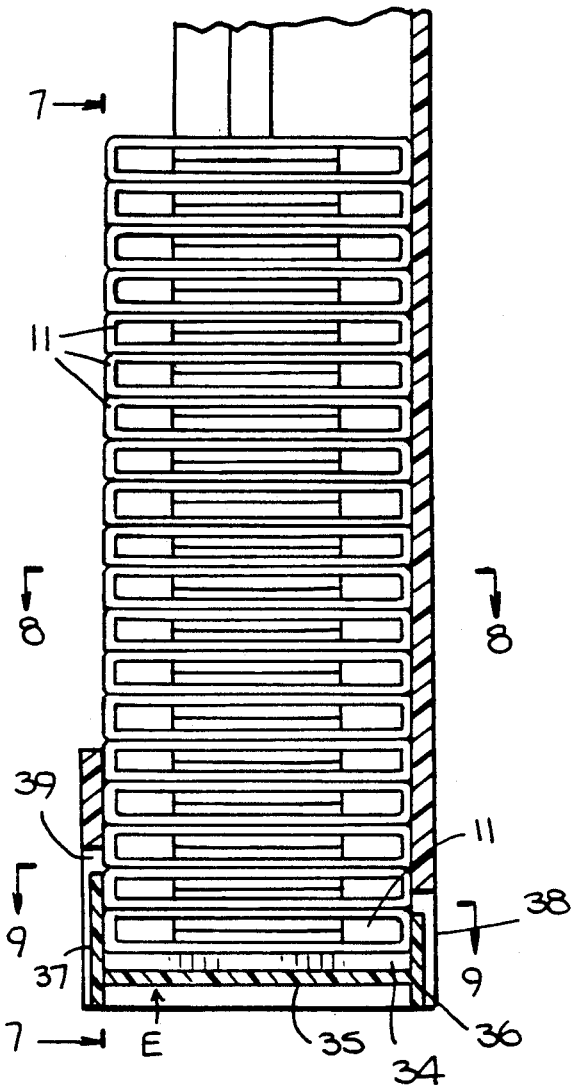
FIG. 6 is a longitudinal section taken through the lower portion of the cartridge in a plane parallel to its sides.
Figure 7:
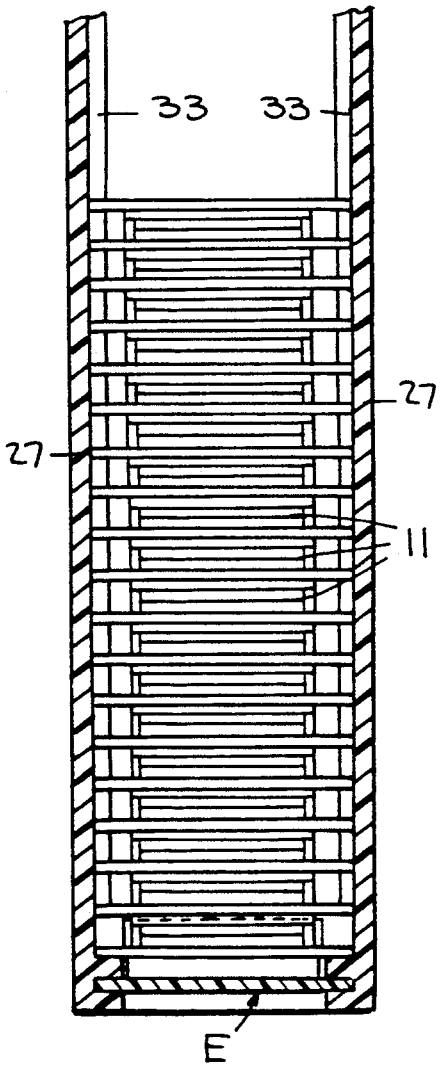
FIG. 7 is a longitudinal section taken through the cartridge in a plane normal to its sides, as indicated by line 7—7 in FIG. 6.
Figure 8:
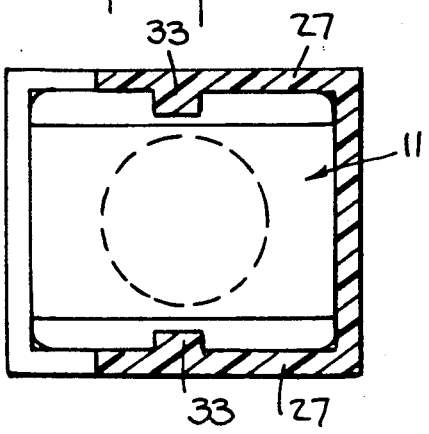
FIG. 8 is a transverse section taken through the cartridge in a plane indicated by line 8—8 in FIG. 6.

When the ejector is in its fully retracted position, as shown in FIG. 6, rear plate 36 then fits within an opening 38 in the rear wall of the cartridge and is then behind the lowermost mini-compact 11 in the stack, the front plate then fitting in an opening 39 in the front of the cartridge below slot S.

When ejector E is pulled out by a finger engaging the lower edge of front plate 37, as shown in FIGS. 11 and 12, the lowermost mini-compact, which is resting on the ledge, is engaged by the rear plate 36 of the ejector and is carried out of the exit slot S, so that it may be manually taken out of the ejector. During this ejection action, rear plate 36, as shown in FIG. 12, prevents the next mini-compact in the stack from falling down onto ledges 34. But when the ejector is pushed back to occupy its retracted position in which rear plate 36 is then in the opening 38 in the rear wall of the cartridge, the next and now lowermost mini-compact in the stack then drops onto the ledges in readiness for the next ejector action.

Thus when a consumer who wishes to test various cosmetics before deciding which one to purchase may, when presented with the array of dispenser cartridges supported on the common stand 12, operate the ejectors to obtain sample mini-compacts of possible interest. In practice, the bridges $B_1$, $B_2$ and $B_3$ of the cartridges may carry labels to identify the cosmetics carried in each cartridge by manufacturer and brand, or these labels may be attached to the removable lid L of the cartridge. When a cartridge is exhausted, it may be removed from the stand and returned to the cosmetic manufacturer for reloading.

For promotional purposes, a manufacturer may distribute to consumers by mail or by other means packets containing a group of mini-compacts each containing a different cosmetic sample from the manufacturer's line.

While there has been shown and described a preferred embodiment of a dispenser cartridge for cosmetic sample mini-compacts in accordance with the invention, it will be appreciated that many changes and modifications may be made therein without, however, departing from the essential spirit thereof. Thus the mini-compacts, instead of being in rectangular form as shown, may be in round form, a round lid being hinged to a round base plate having notches at diametrically opposed positions so that the compact can be loaded into a dispenser having side rails in which the notches are received.

I claim:

1. A stackable mini-compact containing a sample of a particular cosmetic which may be in solid, semi-solid or viscous form, said compact comprising:

(a) a small rectangular base plate having formed on its top surface a shallow tray filled with the sample; and (b) a rectangular planar lid hinged to the base plate and having formed on its under surface a complementary ring which when the lid is closed and is in parallel relation to the base plate to render the compact stackable, the ring is then in frictional engagement with the tray to seal the sample, said lid having a narrower width than that of the plate, whereby when the lid is closed, side margins of the plate are exposed, which margins are usable to retain the compact in a cartridge in which it is stacked.

2. A mini-compact as set forth in claim 1, formed of synthetic plastic material and in which the plate is hinged to the lid by a living hinge of the same material.

3. A mini-compact as set forth in claim 1, wherein said tray and said ring are circular.

4. A mini-compact as set forth in claim 1, wherein said tray and ring are square.

5. A mini-compact as set forth in claim 1, wherein said side margins are provided with opposing notches.

6. A mini-compact as set forth in claim 1, wherein said lid is provided with a front apron that when the lid is closed snaps onto the front edge of the plate.

7. A dispenser cartridge loadable with a stack of mini-compacts as set forth in claim 1, said cartridge being vertically mountable and comprising:

(a) a vertical channel for accommodating said stack, said channel having a rectangular cross section defined by a pair of parallel side walls;

(b) a ledge at the bottom end of the cartridge on which rests the lowermost mini-compact in the stack at a position in registration with an exit slot; and (c) a slidable ejector below the ledge and having an upstanding rear plate which when the ejector is pulled out carries the lowermost mini-compact out of the exit slot and while doing so prevents the next mini-compact from dropping onto the ledge, and which, when pushed back, then permits the next mini-compact to drop onto the ledge in readiness for ejection, said side walls being provided at their inner surface with vertical rails, said mini-compact having notches in its side margins to receive the rails.

8. A dispenser cartridge as set forth in claim 7, wherein said cartridge has a removable lid at its upper end to permit refilling of the cartridge with mini-compacts.

9. A dispenser cartridge as set forth in claim 7, mountable on a vertical stand having a pair of parallel ridges which are spaced to accommodate the cartridge, the ridges having lugs projecting therefrom terminating in knobs which are received in locking slots formed in the side walls of the cartridge.

* * * * *